US010468800B2

(12) United States Patent
Huang et al.

(10) Patent No.: US 10,468,800 B2
(45) Date of Patent: Nov. 5, 2019

(54) ELECTRICAL CONNECTOR ASSEMBLY AS WELL AS BOARD CONNECTOR AND CABLE CONNECTOR THEREOF

(71) Applicant: Tarng Yu Enterprise co., ltd., New Taipei (TW)

(72) Inventors: Mu-Jung Huang, New Taipei (TW); Ying-Chung Chen, New Taipei (TW); Chai-Fa Chang, New Taipei (TW)

(73) Assignee: TARNG YU ENTERPRISES CO., LTD., New Taipei (TW)

( * ) Notice: Subject to any disclaimer, the term of this patent is extended or adjusted under 35 U.S.C. 154(b) by 0 days.

(21) Appl. No.: 16/043,136

(22) Filed: Jul. 23, 2018

(65) Prior Publication Data

US 2019/0109394 A1 Apr. 11, 2019

(30) Foreign Application Priority Data

Oct. 6, 2017 (TW) ..... 106134534 A
Dec. 29, 2017 (TW) ..... 106146560 A

(51) Int. Cl.

| | |
|---|---|
| ***H01R 3/00*** | (2006.01) |
| ***H01R 12/79*** | (2011.01) |
| ***H01R 12/70*** | (2011.01) |
| *H01R 12/71* | (2011.01) |

(52) U.S. Cl.
CPC ..... *H01R 12/79* (2013.01); *H01R 12/7005* (2013.01); *H01R 12/716* (2013.01)

(58) Field of Classification Search
CPC .... H01R 12/79; H01R 12/592; H01R 23/662; H01R 13/65802; H01R 23/7073
USPC ..... 439/492, 494, 497, 499, 607.01, 660
See application file for complete search history.

(56) References Cited

U.S. PATENT DOCUMENTS

| | | | | |
|---|---|---|---|---|
| 4,975,069 | A * | 12/1990 | Fedder | H01R 12/775 439/101 |
| 5,295,843 | A * | 3/1994 | Davis | H01R 13/26 439/108 |
| 5,518,421 | A * | 5/1996 | Davis | H01R 13/506 439/607.5 |
| 5,876,248 | A * | 3/1999 | Brunker | H01R 13/6582 439/607.08 |
| 6,648,676 | B1 * | 11/2003 | Lee | H01R 43/24 439/499 |
| 6,705,893 | B1 * | 3/2004 | Ko | H01R 12/714 439/497 |
| 6,744,634 | B2 * | 6/2004 | Yen | G06K 19/07732 361/752 |
| 6,932,646 | B2 * | 8/2005 | Sloey | H01R 13/6581 439/607.4 |

(Continued)

*Primary Examiner* — Thanh Tam T Le
(74) *Attorney, Agent, or Firm* — LanWay IPR Services; Chun-Ming Shih

(57) ABSTRACT

An electrical connector assembly as well as a board connector and a cable connector thereof are provided, in which power terminals and signal terminal are designed with different terminal structures in response to different functions, in order to ensure delivery of power and signal between the board connector and the cable connector, as well as reduce volumes occupied by the power terminals and the signal terminal in the board connector and the cable connector respectively, for achieving the purpose of reducing feature dimensions of the electrical connector assembly as well as the board connector and the cable connector thereof.

8 Claims, 29 Drawing Sheets

(56) References Cited

U.S. PATENT DOCUMENTS

| | | | | |
|---|---|---|---|---|
| 6,945,824 | B1 * | 9/2005 | Li | H01R 13/26 439/660 |
| 7,255,607 | B1 * | 8/2007 | Wu | H01R 27/00 439/660 |
| 7,534,141 | B1 * | 5/2009 | Wu | H01R 24/62 439/607.01 |
| 7,553,167 | B2 * | 6/2009 | Zhang | H01R 4/2433 439/497 |
| 7,794,273 | B2 * | 9/2010 | Xu | H01R 12/59 411/45 |
| 7,824,198 | B2 * | 11/2010 | Tanaka | H01R 9/034 439/108 |
| 7,931,501 | B1 * | 4/2011 | Chiang | H01R 12/724 439/607.01 |
| 7,955,137 | B2 * | 6/2011 | Ko | H01R 13/506 439/607.45 |
| 8,052,479 | B1 * | 11/2011 | Zhu | H01R 12/57 439/660 |
| 8,398,427 | B2 * | 3/2013 | Wu | H01R 4/02 439/497 |
| 8,696,390 | B2 * | 4/2014 | Tai | H01R 13/115 439/660 |
| 8,900,013 | B2 * | 12/2014 | Li | H01R 12/53 439/660 |
| 9,318,859 | B2 * | 4/2016 | Chen | H01R 31/06 |

* cited by examiner

ELECTRICAL CONNECTOR ASSEMBLY AS WELL AS BOARD CONNECTOR AND CABLE CONNECTOR THEREOF

CROSS-REFERENCE TO RELATED APPLICATIONS

This application claims the priority of Republic of China Patent Application Nos. 106134534 and 106146560 filed on Oct. 6, 2017, and Dec. 29, 2017, respectively, in the State Intellectual Property Office of the R.O.C., the disclosure of which is incorporated herein by reference.

BACKGROUND OF THE INVENTION

Field of the Invention

The invention relates to an electrical connector assembly as well as a board connector and a cable connector thereof, and more specifically, to an electrical connector assembly as well as a board connector and a cable connector thereof with power terminal and signal terminal of different structures.

Descriptions of the Related Art

Conventionally, an electrical connector usually includes power terminal and signal terminal for separate transmission of power and signal, such that the electrical connector is applied in various types of electronic products widely. However, with technical advancement, performance of electronic products is improved substantially, while there are multitudes of power and signal patterns required to be transmitted in the electrical connector, so that the power terminal and the signal terminal disposed on the electrical connector cannot be decreased, and as such, feature dimension of the electrical connector cannot be reduced.

Typically, in order for an electrical connector to function in an electronic product which is disposed, there is strict requirement for feature dimension of the electrical connector in the industry, in order to ensure that the electrical connector can be disposed in the electronic product without interfering with other components. The applicability will be constrained if the feature dimension of the electrical connector cannot be reduced.

Therefore, how to reduce feature dimension of an electrical connector has become an existing technical issue to be resolved eagerly in the industry.

SUMMARY OF THE INVENTION

In view of the above drawbacks in the conventional technology, the present invention is to provide An electrical connector assembly for delivering a first power of a first power wire, a second power of a second power wire, and an electronic signal of a signal wire to a circuit substrate separately, the electrical connector assembly including: a board connector having a board insulator, a board signal terminal set, a first board power terminal set and a second board power terminal set, wherein: the first, second board power terminal sets and the board signal terminal set are embedded in the board insulator, and the board signal terminal set is located between the first, second board power terminal sets; the board signal terminal set has at least one board signal terminal; the first board power terminal set has at least one first board power terminal; the second board power terminal set has at least one second board power terminal; and the first, second board power terminals and the board signal terminal have separate lapping parts exposed out of the board insulator for lapping the circuit substrate; a cable connector for docking the board connector, the cable connector having a cable insulator, a cable signal terminal set, a first cable power terminal set and a second cable power terminal set, wherein: the first, second cable power terminal sets and the cable signal terminal set are embedded in the cable insulator, and the cable signal terminal set is located between the first, second cable power terminal sets; the cable signal terminal set has at least one cable signal terminal, one end of the cable signal terminal lapping the signal wire to receive the electronic signal, another end of the cable signal terminal having a cable resistive contact structure on a surface thereof, which is used to contact the board signal terminal resistively when the cable connector docks the board connector, for delivering the electronic signal to the circuit substrate via the board signal terminal; the first cable power terminal set has at least one first cable power terminal, one end of the first cable power terminal lapping the first power wire to receive the first power, another end of the first cable power terminal having a first clamp arm structure, which is used to clamp the first board power terminal elastically when the cable connector docks the board connector, for delivering the first power to the circuit substrate via the first board power terminal; and the second cable power terminal set has at least one second cable power terminal, one end of the second cable power terminal lapping the second power wire to receive the second power, another end of the second cable power terminal having a second clamp arm structure, which is used to clamp the second board power terminal elastically when the cable connector docks the board connector, for delivering the second power to the circuit substrate via the second board power terminal.

Preferably, the electrical connector assembly said above, wherein the board insulator has a first level guiding structure, a second level guiding structure and a third level guiding structure; the cable insulator has a first insertion structure, a second insertion structure and a third insertion structure; when the cable connector docks the board connector, the first, second, third level insertion structures are in separate correspondence with locations of the first, second, third level guiding structures, for the first, second, third insertion structures to be guided and inserted in the board insulator in sequence by stages until the cable signal terminal contacts the board signal terminal, and for the first, second cable power terminals to be guided clamping the first, second board power terminals separately and elastically.

Preferably, the electrical connector assembly said above, wherein the wall on the inner edge of the board insulator is formed of the first, second, third level guiding structures separately.

Preferably, the electrical connector assembly said above, further includes multiple reinforcement pieces, which are provided on the two walls on inner and outer edges on two sides of the board insulator, and join with the circuit substrate separately, to ensure lapping of the board signal terminal and the first, second board power terminals onto the circuit substrate; each of the multiple reinforcement pieces has an reinforcement piece guiding structure, for guiding the first level insertion structure to approach the first level guiding structure within a predetermined angular range.

Preferably, the electrical connector assembly said above, wherein the board insulator further has an insertion stop structure, which stops the first level insertion structure of the cable insulator from approaching the first level guiding structure at a non-predetermined angular range.

Preferably, the electrical connector assembly said above, wherein the board signal terminal has both head and tail ends embedded in the board insulator; an elastic embossed structure is formed at the neck portion on the head end of the board signal terminal; the elastic embossed structure is a middle portion exposed out of the inner edge of the board insulator, and protrudes toward the cable signal terminal for contacting the cable resistive contact structure.

Preferably, the electrical connector assembly said above, wherein the head ends of the first, second board power terminals are formed of a first pillar structure and a second pillar structure separately for being clamped by the first, second cable power terminals elastically and separately; the tail ends of the first, second board power terminals being embedded in the board insulator separately.

Preferably, the electrical connector assembly said above, wherein the head end of the cable signal terminal has a U-shaped structure; the cable insulator has a longitudinal stop structure, which may be embedded in the U-shaped structure for stopping longitudinal motion of the head end of the cable signal terminal relative to the cable insulator.

Preferably, the electrical connector assembly said above, wherein the head end of the cable signal terminal has an embedding hole for passing through the longitudinal stop structure to complete the embedding of the longitudinal stop structure in the U-shaped structure.

Preferably, the electrical connector assembly said above, wherein the opposing faces of the board, cable insulators are formed with a board clipping structure and a cable clipping structure separately in order to clip both of the board clipping structure and the cable clipping structure as the cable connector has docked the board connector.

Furthermore, the present invention further provides a board connector, including: a board signal terminal set having at least one board signal terminal; a first board power terminal set having at least one first board power terminal, the first board power terminal and the board signal terminal being distinct with respect to terminal structure; and a second board power terminal set having at least one second board power terminal, the second board power terminal and the board signal terminal being distinct with respect to terminal structure; wherein, the board signal terminal set is located between both the first, second board power terminal sets.

Preferably, the board connector said above, wherein the head ends of the first, second board power terminals are formed of a first pillar structure and a second pillar structure separately; the board signal terminal is formed of an elastic embossed structure.

Moreover, the present invention further provides a cable connector, including: a cable signal terminal set having at least one cable signal terminal; a first cable power terminal set having at least one first cable power terminal, the first cable power terminal and the cable signal terminal being distinct with respect to terminal structure; a second cable power terminal set having at least one second cable power terminal, the second cable power terminal and the cable signal terminal being distinct with respect to terminal structure; wherein, the cable signal terminal set is located between both the first, second cable power terminal sets.

Preferably, the board connector said above, wherein the head ends of the first, second cable power terminal are formed of a first clamp arm structure and a second clamp arm structure separately; the head end of the cable signal terminal are formed of a cable resistive contact structure.

Compared to prior arts, in an electrical connector assembly as well as a board connector and a cable connector thereof according to the invention, a cable power terminal clamps a pillar structure of a board power terminal through a clamp arm structure elastically to ensure that electric quantity of power delivered between the cable power terminal and the board power terminal meets expectation, while a cable signal terminal contacts an elastic embossed structure of a board signal terminal through a cable resistive contact structure resistively to ensure that signal can be delivered between the cable signal terminal and the board signal terminal with reduced feature dimensions of the cable signal terminal and the board signal terminal, for achieving the purpose of reducing feature dimensions of the cable connector and the board connector.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
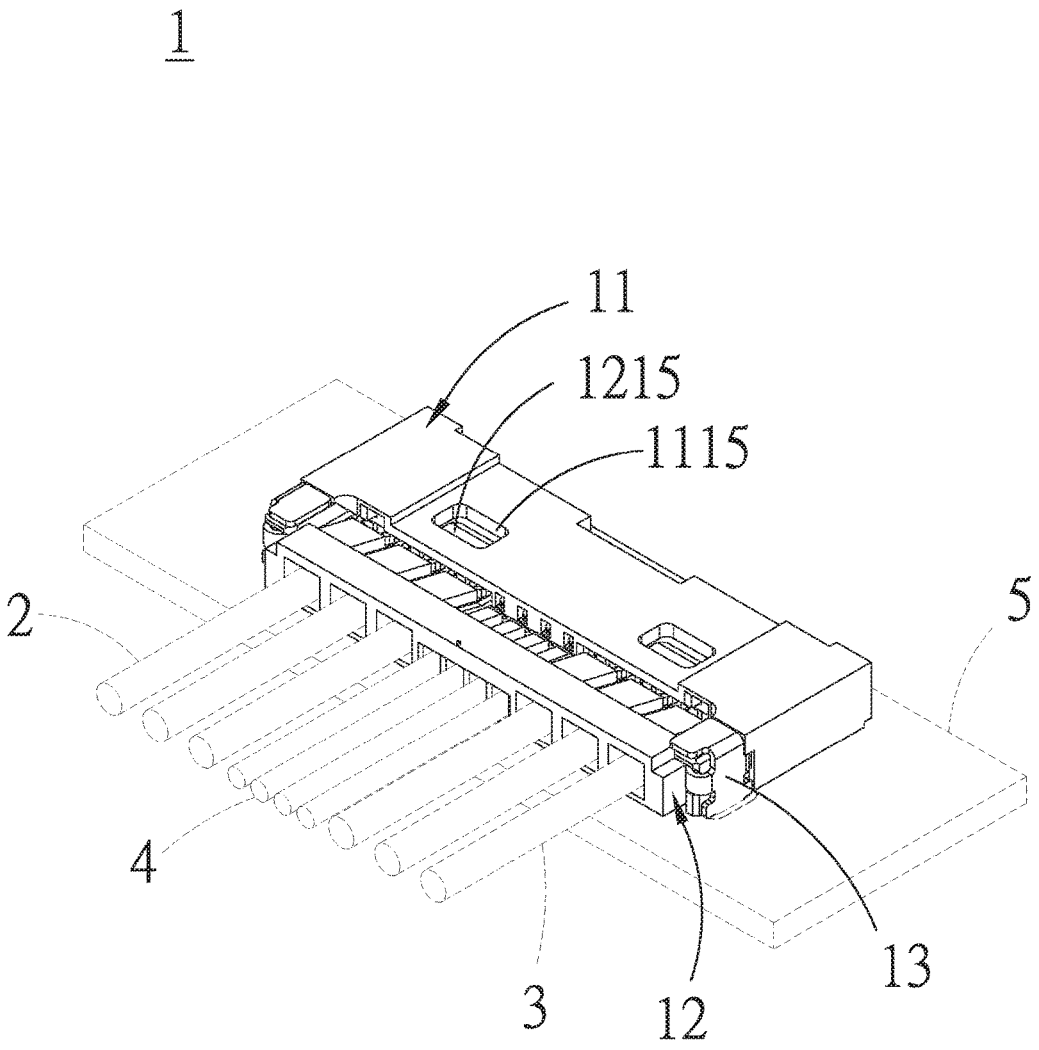
FIG. 1 is a schematic view showing usage of an electrical connector assembly according to the invention.
Figure 2:
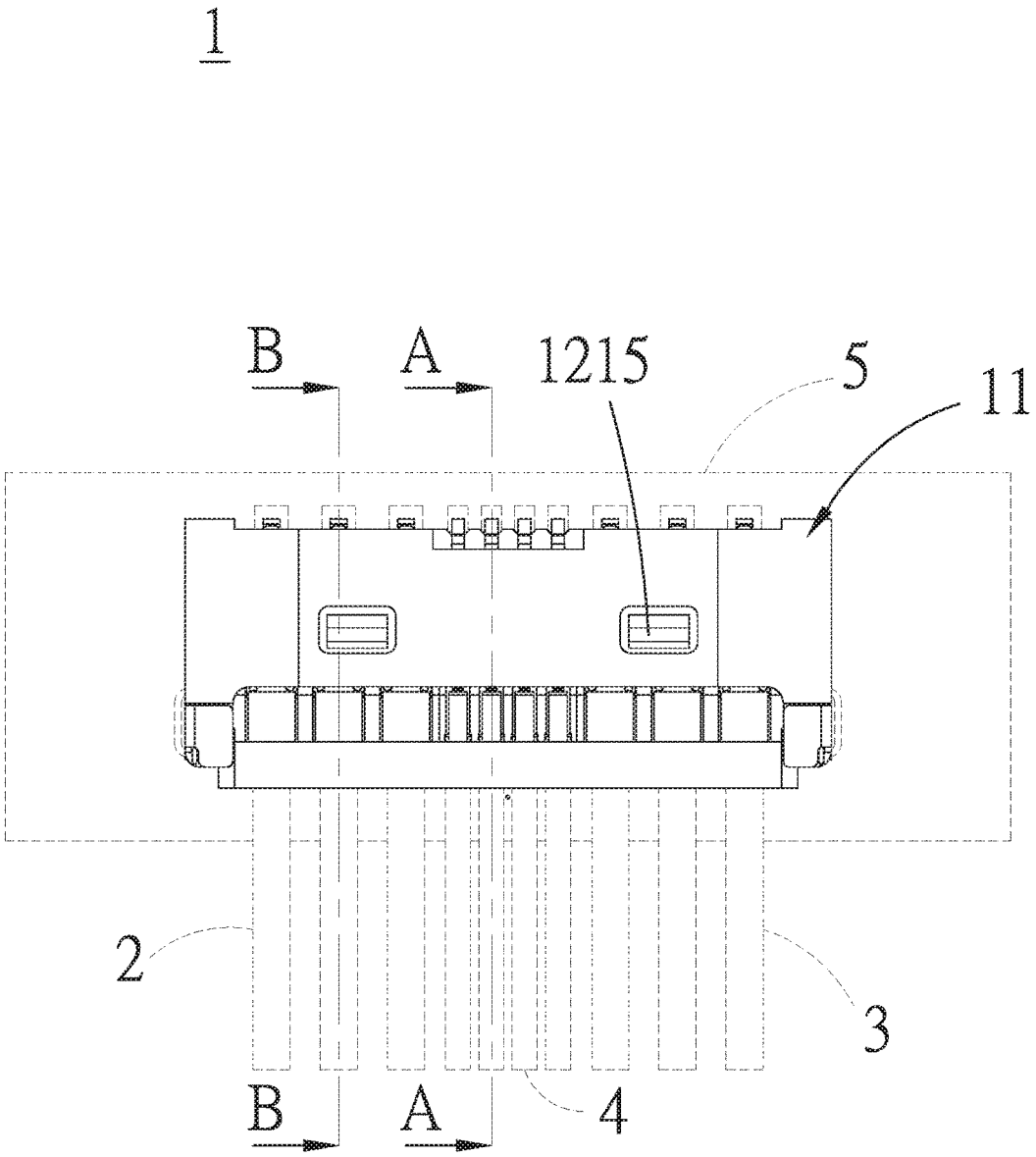
FIG. 2 is a top view of the electrical connector assembly shown in FIG. 1.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

An electrical connector assembly as well as a board connector and a cable connector thereof according to the invention, in which power terminals and signal terminal are designed with different terminal structures in response to different functions, in order to ensure delivery of power and signal between the board connector and the cable connector, as well as reduce volumes occupied by the power terminals and the signal terminal in the board connector and the cable connector respectively, for achieving the purpose of reducing feature dimensions of the electrical connector assembly as well as the board connector and the cable connector thereof.

Refer to FIGS. 1 through 29 in conjunction, which illustrate examples describing technical thought according to the invention.

As shown in FIGS. 1 through 10, an electrical connector assembly 1 according to the invention may be used for delivering a first power of a first power wire 2, a second power of a second power wire 3, and an electronic signal of a signal wire 4 to a circuit substrate 5 separately. The first, second powers are used for providing electric energy to the circuit substrate 5, such that the circuit substrate 5 can operate. The electronic signal is a required signal provided for the circuit substrate 5 to operate.

The electrical connector assembly 1 has a board connector 11 and a cable connector 12. The cable connector 12 is used for docking the board connector 11. The board connector 11 has a board insulator 111 as well as a first, a second board power terminal sets 113, 114 and a board signal terminal set 112 embedded in the board insulator 111. The board signal terminal set 112 is located between the first, second board power terminal sets 113, 114.

Figure 20:
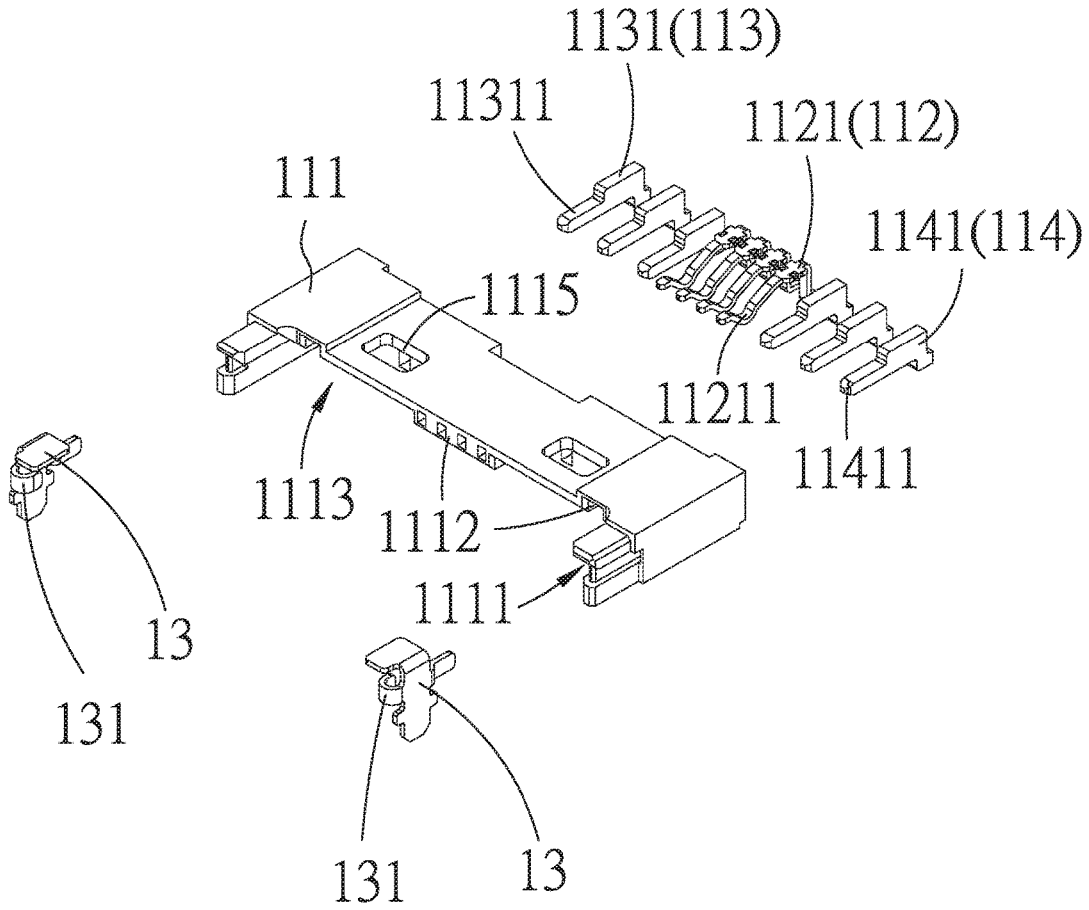
FIGS. 20 and 21 are exploded views showing the board connector shown in FIG. 19.
Figure 21:
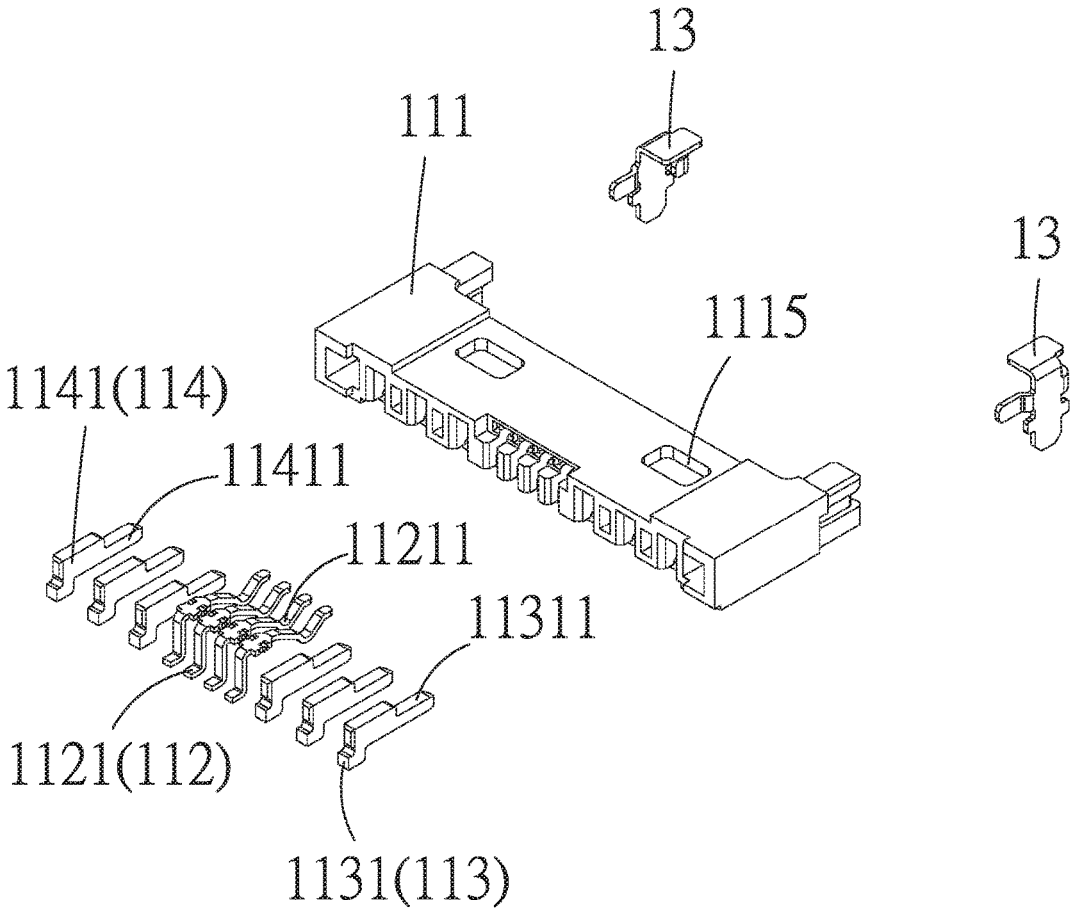
Figure 22:
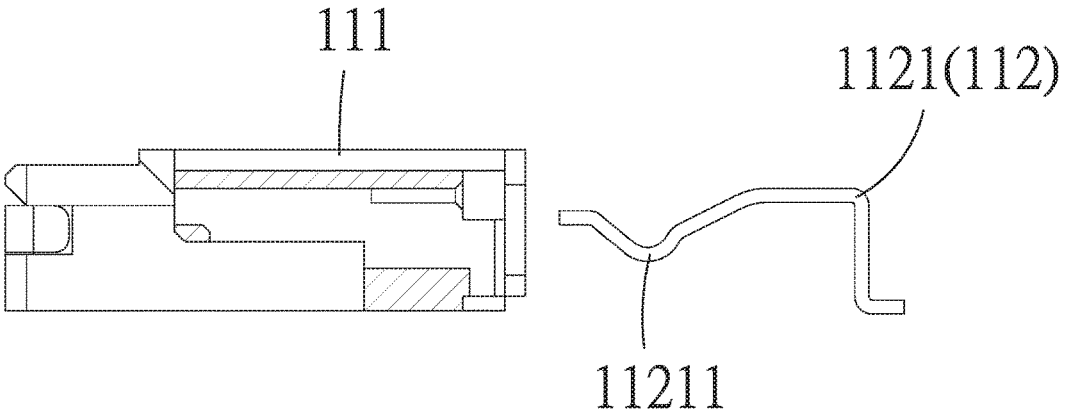
FIGS. 22 and 23 are schematic views showing processes of embedding a board signal terminal in a board insulator according to the invention.
Figure 23:
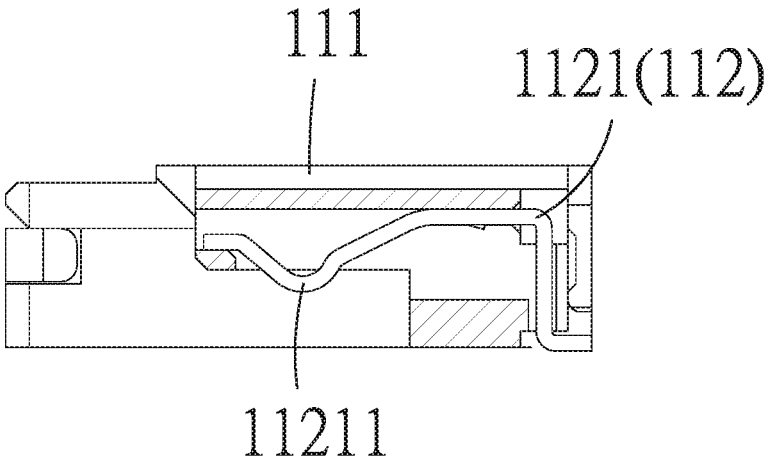
Figure 24:
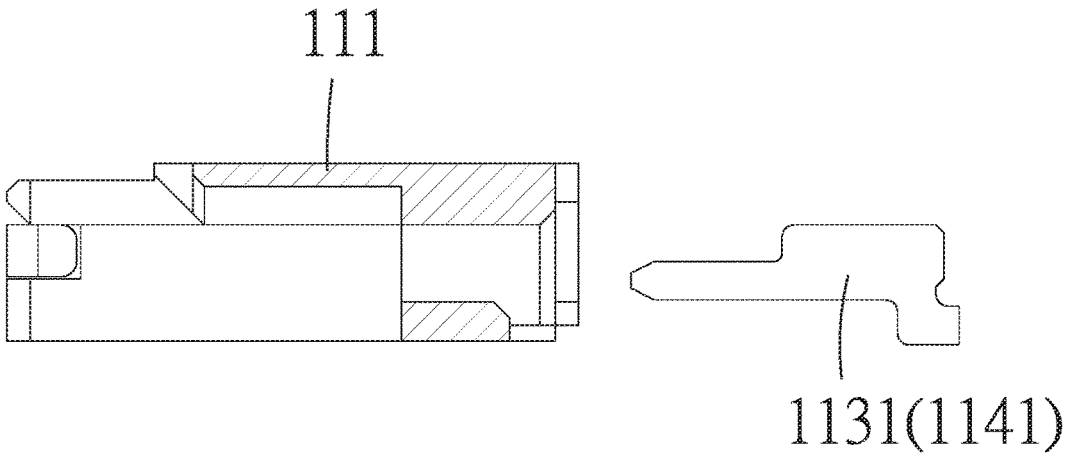
FIGS. 24 and 25 are schematic views showing processes of embedding a first (second) board power terminal in board insulator according to the invention.
Figure 25:
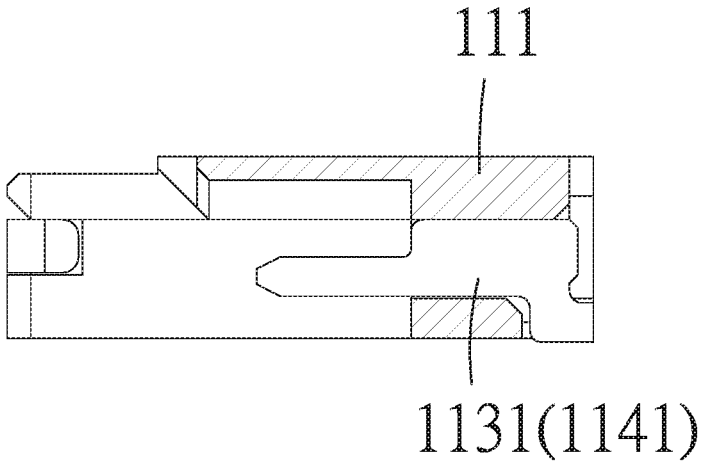

The board signal terminal set 112 has board signal terminal 1121 with both head and tail ends embedded in the board insulator 111. As shown in FIGS. 20 and 21, the board signal terminal set 112 has four board signal terminals 1121, and an elastic embossed structure 11211 is formed at the neck portion on the head end of the board signal terminal 1121. The elastic embossed structure 11211 is exposed out at a middle portion of the inner edge of the board insulator 111. The first, second board power terminal sets 113, 114 have first, second board power terminals 1131, 1141 separately. As shown in FIGS. 20 and 21, the first, second board power terminal sets 113, 114 have three first, second board power terminals 1131, 1141 separately, and head ends of the first, second board power terminals 1131, 1141 form first, second pillar structures 11311, 11411 separately. Furthermore, as shown in FIG. 25, the tail ends of the first, second board power terminals 1131, 1141 are embedded in the board insulator 111 to complete locating of the first, second board power terminals 1131, 1141 by the board insulator 111.

Due to different functions of the board signal terminal 1121 and the first, second board power terminals 1131, 1141, terminal structure of the board signal terminal 1121 and that of the first, second board power terminals 1131, 1141 are distinct. As shown in FIGS. 20 and 21, compared to the first, second board power terminals 1131, 1141, a smaller terminal structure is used for the board signal terminal 1121 to thereby achieve the purpose of reducing feature dimension of the board connector 11. Additionally, the first, second board power terminals 1131, 1141 and the board signal terminal 1121 have lapping parts which are exposed out of the board insulator 111 and lap the circuit substrate 5 separately, to which power and electronic signal are delivered, in order for the board 5 to operate according thereto.

In the invention, the cable connector 12 has a cable insulator 121 as well as a first, a second cable power terminal sets 123, 124 and a cable signal terminal set 122 embedded in the cable insulator 121. The cable signal terminal set 122 is located between the first, second cable power terminal sets 123, 124.

Figure 3:
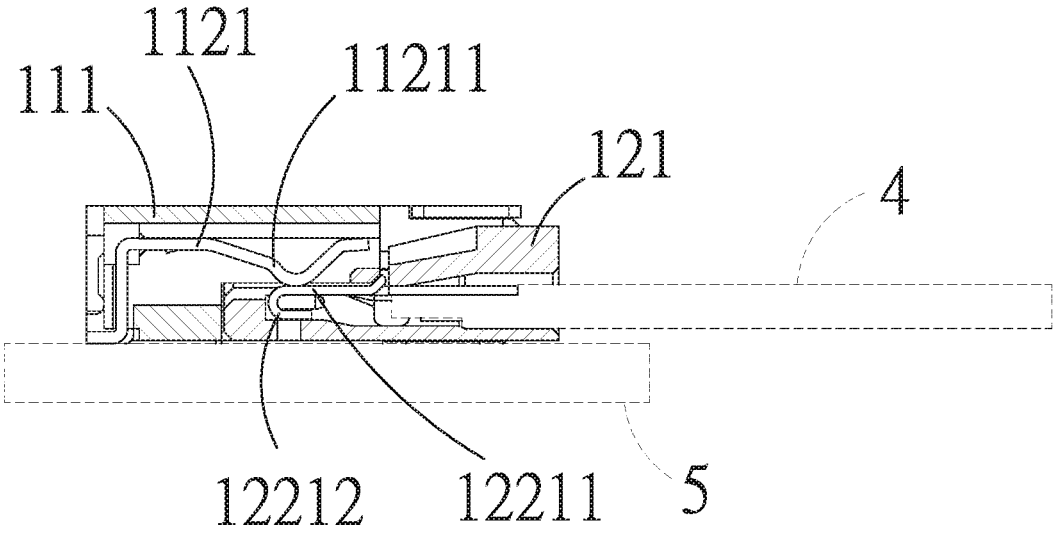
FIG. 3 is a sectional view of the electrical connector assembly taken along line AA in FIG. 2.
Figure 4:
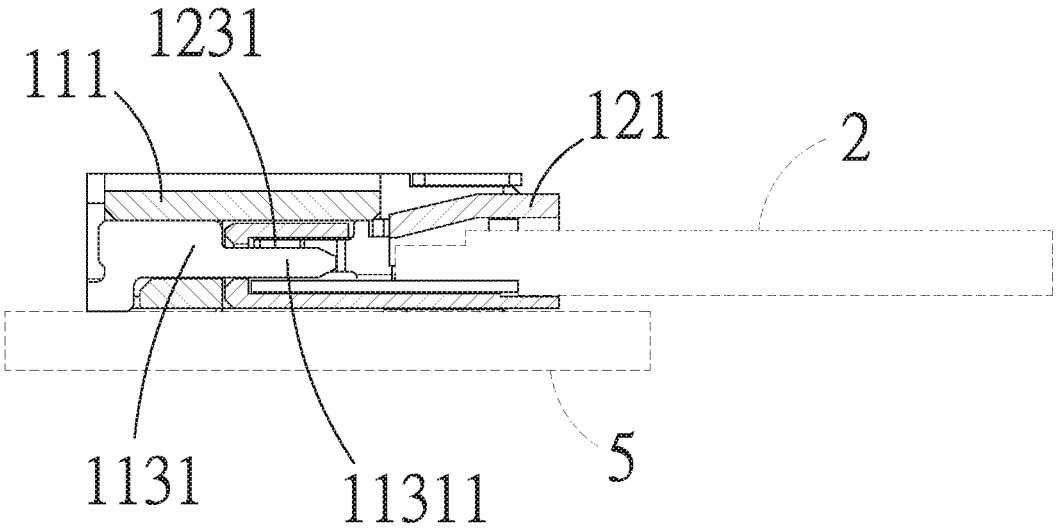
FIG. 4 is a sectional view of the electrical connector assembly taken along line BB in FIG. 2.
Figure 6:
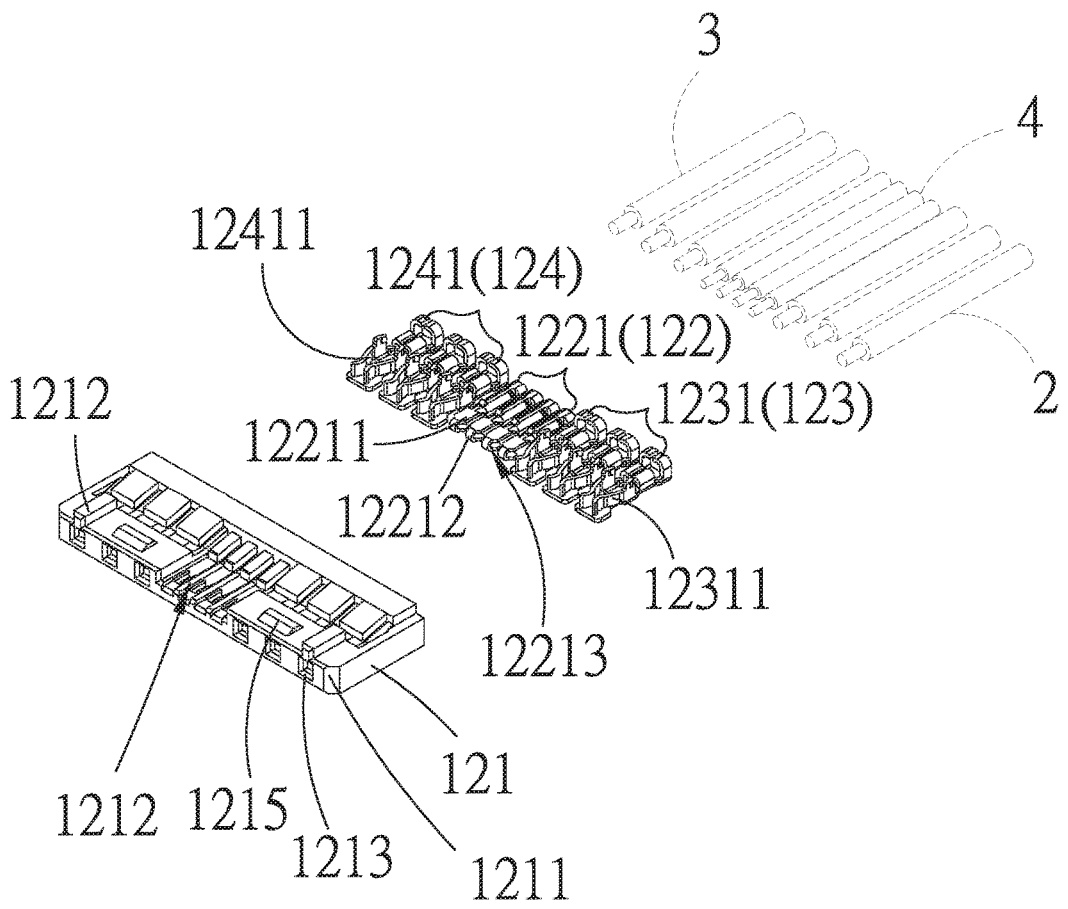
FIGS. 6 through 8 are exploded views showing the cable connector shown in FIG. 5.
Figure 7:
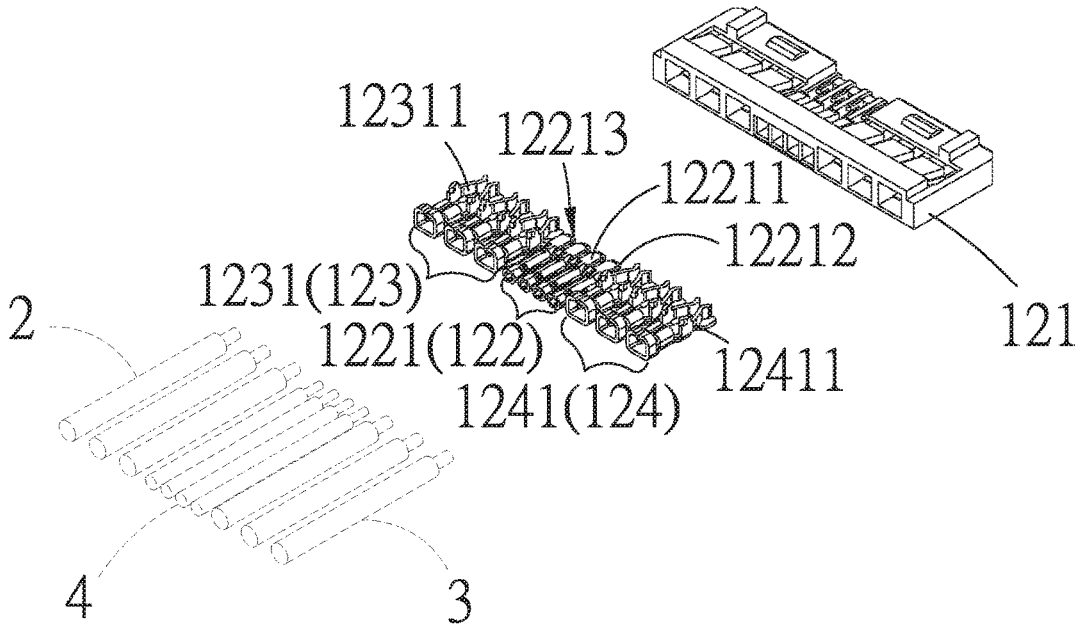
Figure 8:
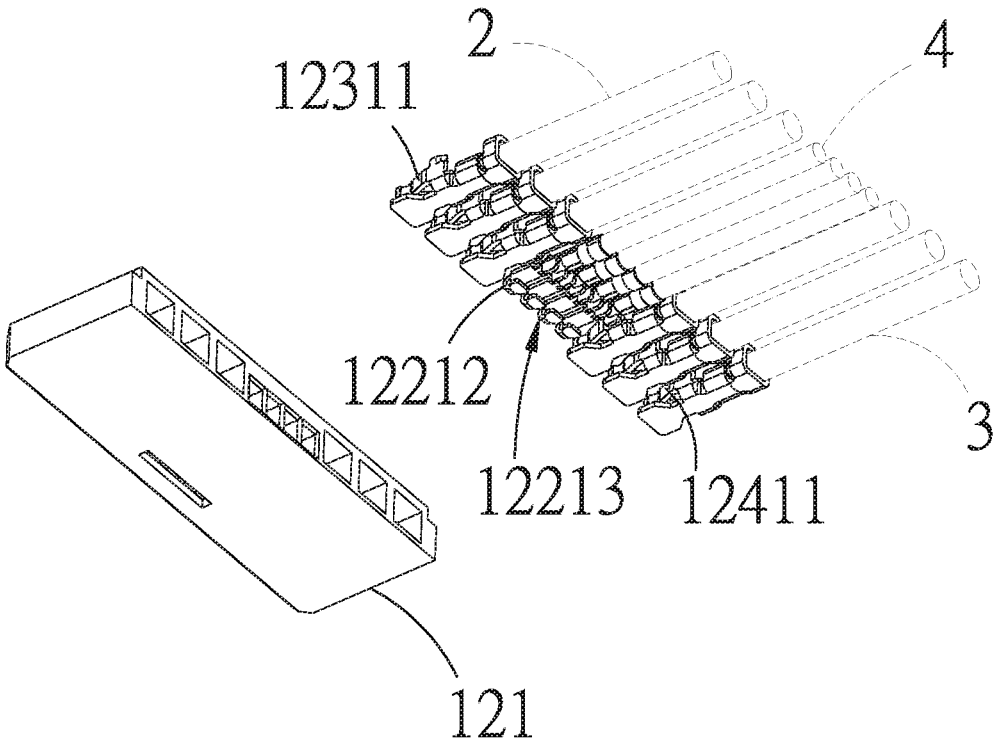
Figure 14:
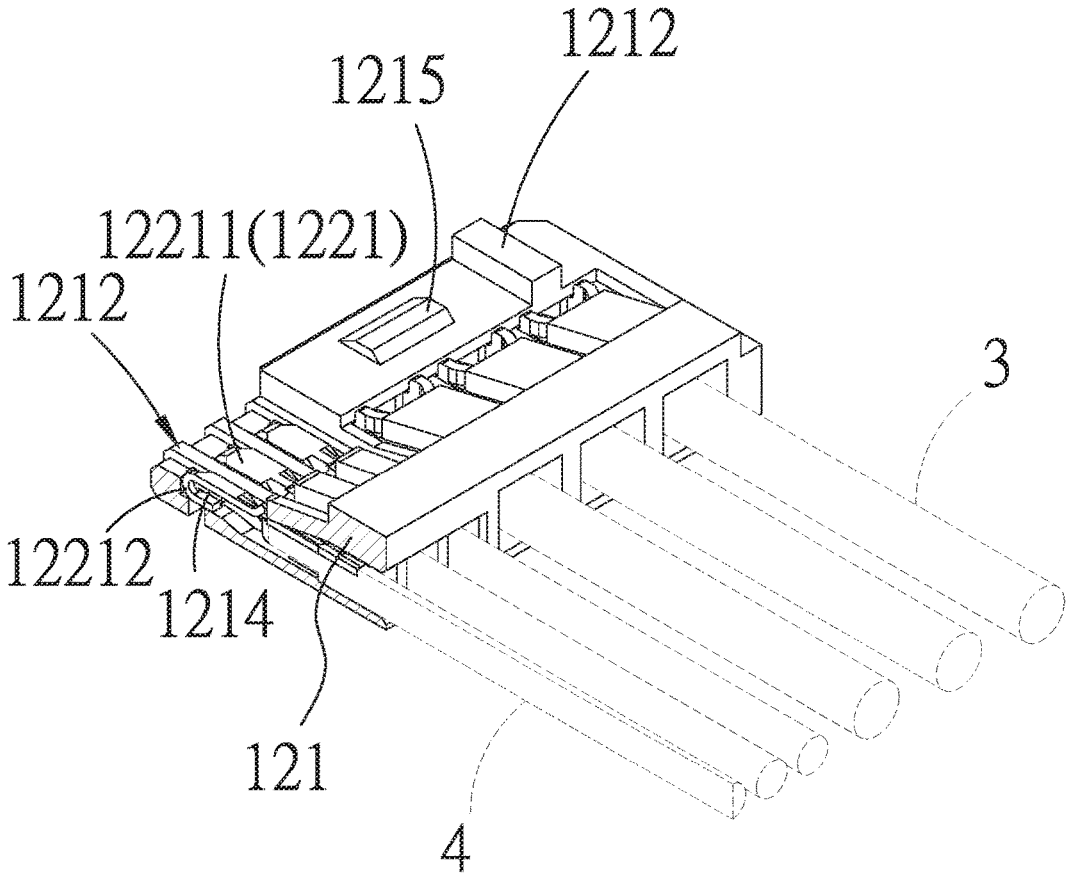
FIGS. 14 and 15 are schematic views showing a status after a cable signal terminal is embedded in a cable insulator according to the invention.
Figure 15:
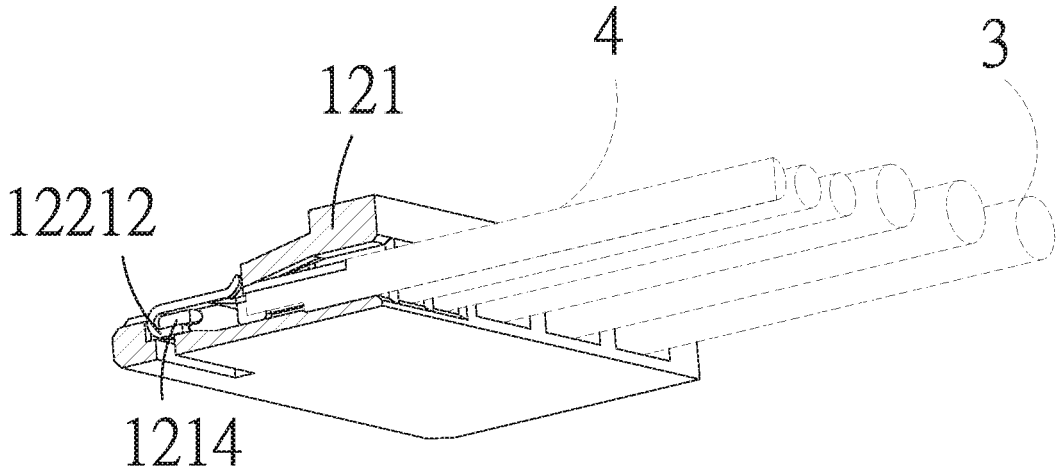
Figure 16:
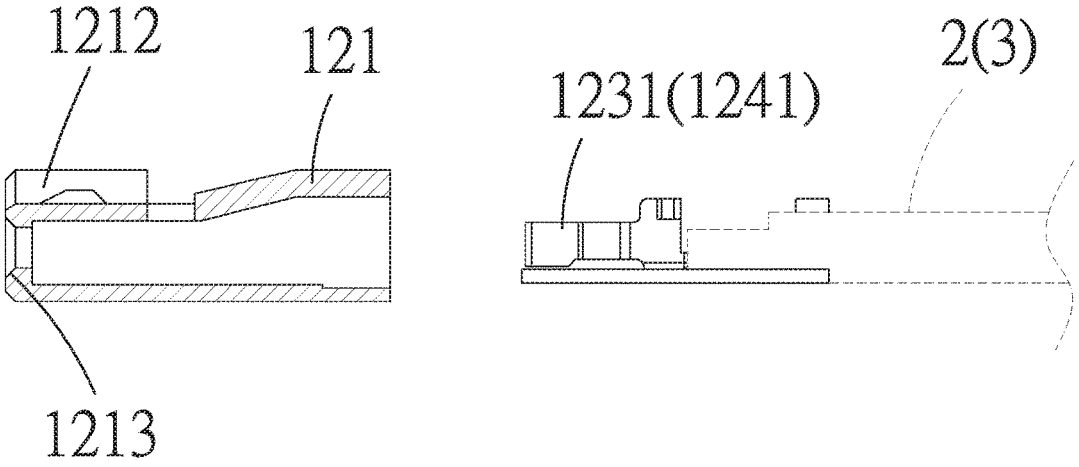
FIGS. 16 through 18 are schematic views showing processes of embedding a first (second) cable power terminal in a cable insulator according to the invention.
Figure 17:
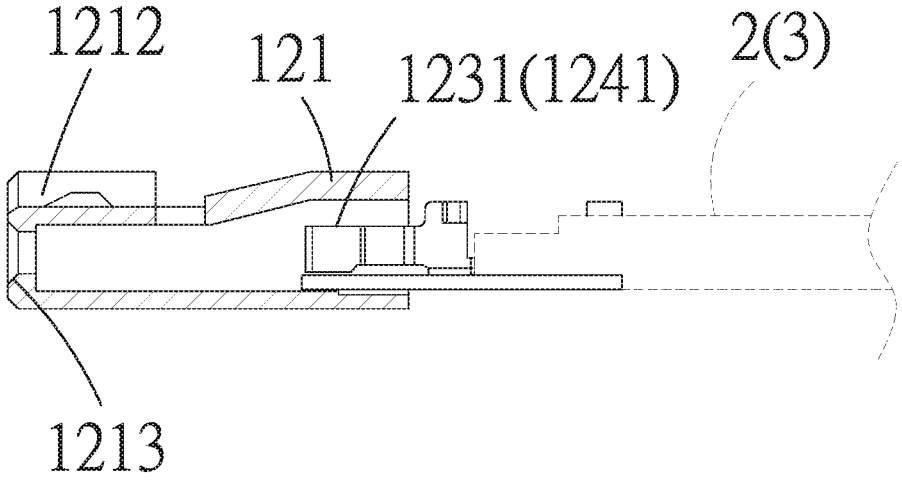
Figure 18:
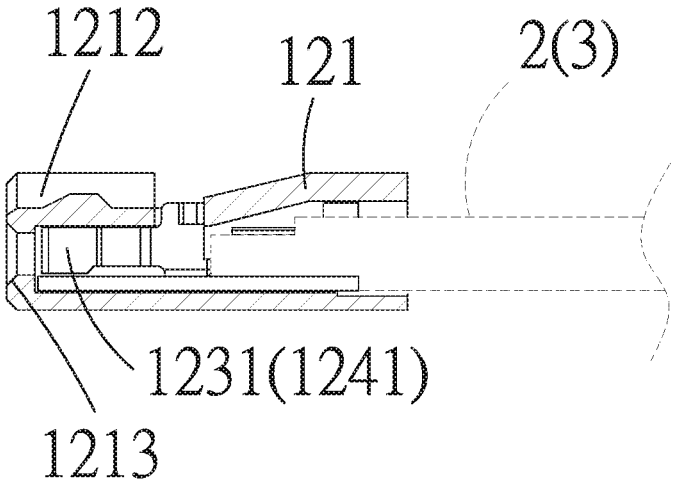

The cable signal terminal set 122 has a cable signal terminal 1221. As shown in FIGS. 6 through 8, the cable signal terminal set 122 has four cable signal terminal 1221 in conjunction with the four board signal terminals 1121 of the board signal terminal set 112. As shown in FIG. 8, the tail end of the cable signal terminal 1221 laps the signal wire 4 to receive electronic signal. As shown in FIG. 14, the head end of the cable signal terminal 1221 has a planar cable resistive contact structure 12211 on a surface thereof. As shown in FIG. 3, the cable resistive contact structure 12211 is used to contact the elastic embossed structure 11211 of the board signal terminal 1121 resistively when the cable connector 12 docks the board connector 11, in order for delivering electronic signals to the circuit substrate 5 via the board signal terminal 1121, so that signal which is required by the circuit substrate 5 for operation is provided.

It should be noted that, the elastic embossed structure 11211 of the board signal terminal 1121 protrudes toward the cable signal terminal 1221, and may be deformed elastically when contacting the cable resistive contact structure 12211 resistively, in order for the board signal terminal 1121 to contact the cable signal terminal 1221 resistively, so that stable delivery of electronic signal between the board signal terminal 1121 and the cable signal terminal 1221 is ensured.

Figure 11:
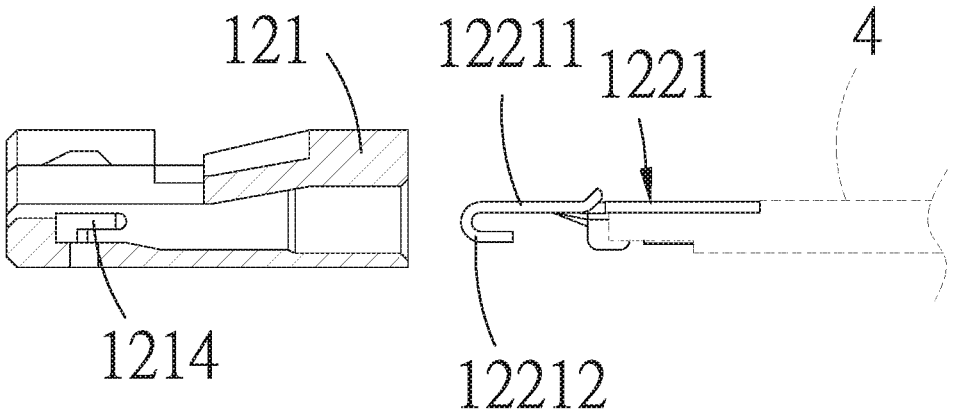
FIGS. 11 through 13 are schematic views showing processes of embedding a cable signal terminal in a cable insulator according to the invention.
Figure 12:
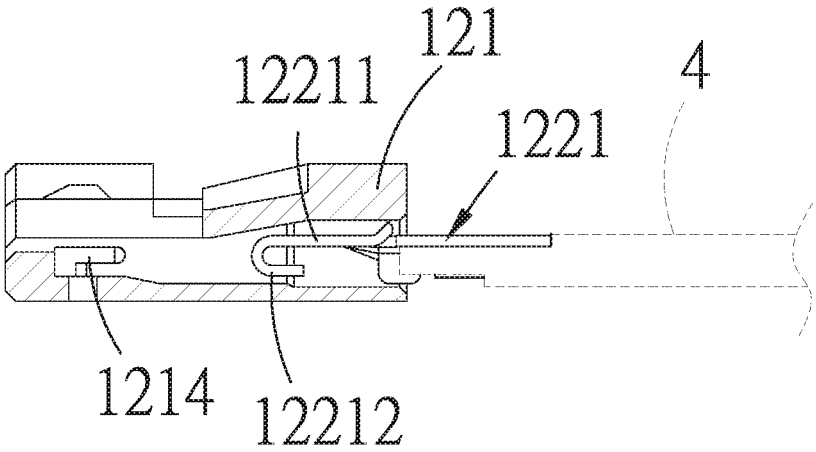
Figure 13:
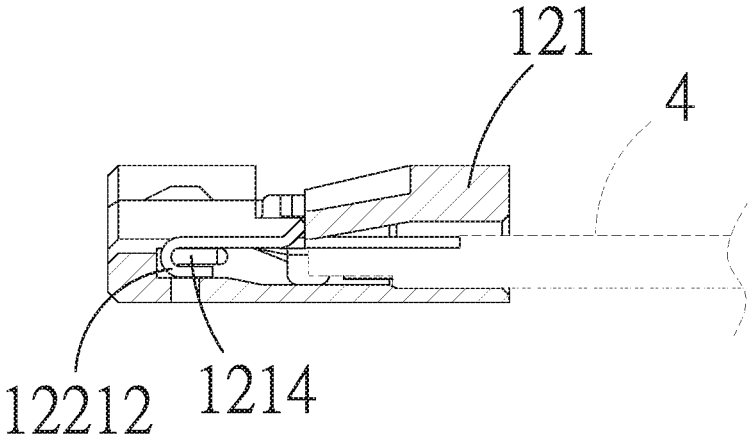

As shown in FIGS. 11 through 15, the head end of the cable signal terminal 1221 has a U-shaped structure 12212. In correspondence, the cable insulator 121 has a longitudinal stop structure 1214, which may be embedded in the U-shaped structure 12212, for stopping longitudinal motion of the head end of the cable signal terminal 1221 relative to the cable insulator 121, to complete locating of the cable signal terminal 1221. Moreover, as shown in FIG. 8, the head end of the cable signal terminal 1221 has an embedding hole 12213 for passing through the longitudinal stop structure 1214 during embedding the cable signal terminal 1221 in the cable insulator 121 (as shown in FIGS. 11 through 13), so that embedding of the longitudinal stop structure 1214 in the U-shaped structure 12212 is completed.

The first cable power terminal set 123 has first cable power terminals 1231. As shown in FIGS. 6 through 8, the first cable power terminal set 123 has three first cable power terminals 1231 in conjunction with the three first board power terminals 1131 of the first board power terminal set 113. As shown in FIG. 8, one end of the first cable power terminal 1231 laps the first power wire 2 to receive the first power. As shown in FIG. 7, another end of the first cable power terminal 1231 has a first clamp arm structure 12311 for clamping a first pillar structure 11311 of a first board power terminal 1131 elastically when the cable connector 12 docks the board connector 11, so that electrical connection between the first cable power terminal 1231 and the first board power terminal 1131 is completed, in order for delivering the first power to the circuit substrate 5 via the first board power terminal 1131, and providing electric energy required by the circuit substrate 5 for operation.

The second cable power terminal set 124 has second cable power terminals 1241. As shown in FIGS. 6 through 8, the second cable power terminal set 124 has three second cable power terminals 1241 in conjunction with the three second board power terminals 1141 of the second board power terminal set 114. As shown in FIG. 8, one end of the second cable power terminal 1241 laps the second power wire 3 to receive the second power. As shown in FIG. 7, another end of the second cable power terminal 1241 has a second clamp arm structure 12411 for clamping a second pillar structure 11411 of a second board power terminal 1141 elastically when the cable connector 12 docks the board connector 11, so that electrical connection between the second cable power terminal 1241 and the second board power terminal 1141 is completed, in order for delivering the second power to the circuit substrate 5 via the second board power terminal 1141, and providing electric energy required by the circuit substrate 5 for operation.

Due to different functions of the cable signal terminal 1221 and the first, second cable power terminals 1231, 1241, terminal structure of the cable signal terminal 1221 and that of the first, second cable power terminals 1231, 1241 are distinct. Such that compared to the first, second cable power terminals 1231, 1241, a smaller terminal structure is used for the board signal terminal 1121 to thereby achieve the purpose of reducing feature dimension of the cable connector 12.

It should be noted that, a cable power terminal clamps a pillar structure of a board power terminal through a clamp arm structure elastically to ensure that electric quantity of power delivered between the cable power terminal and the board power terminal meets expectation, while a cable signal terminal contacts an elastic embossed structure of a board signal terminal through a cable resistive contact structure resistively to ensure that signal can be delivered between the cable signal terminal and the board signal terminal with reduced feature dimensions of the cable signal terminal and the board signal terminal, for achieving the purpose of reducing feature dimensions of the cable connector and the board connector.

Figure 5:
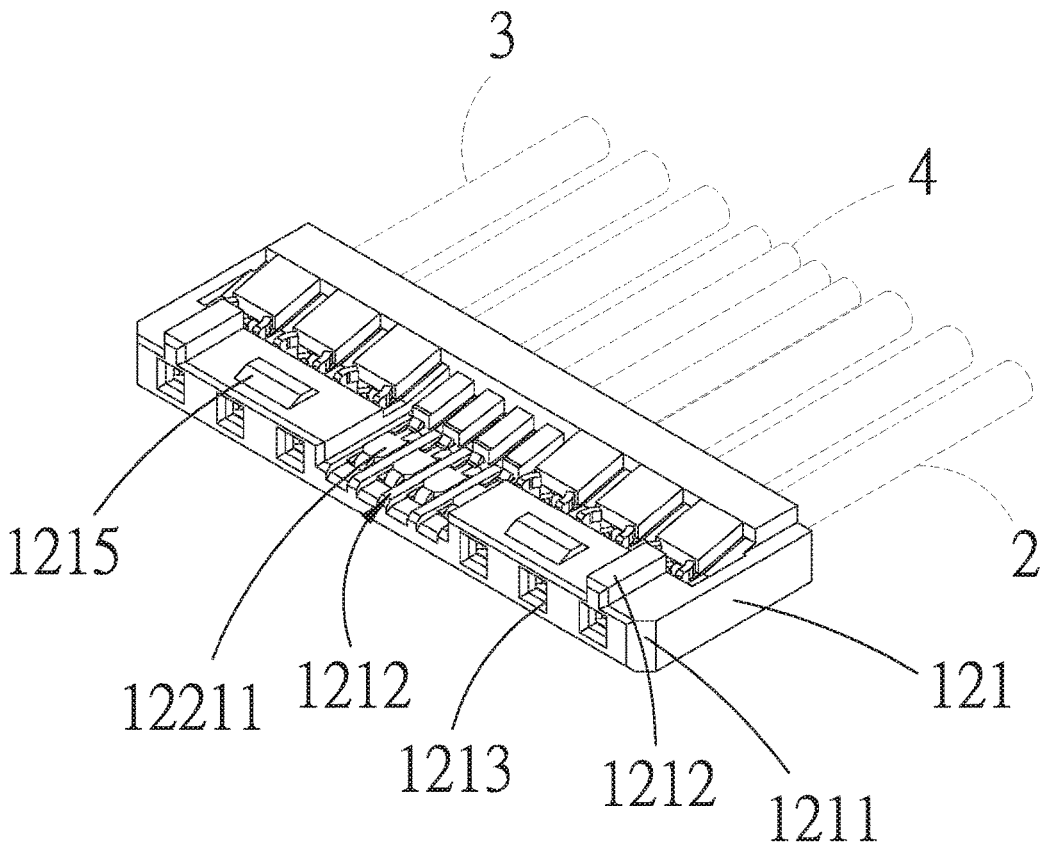
FIG. 5 is a schematic view showing usage of a cable connector according to the invention.
Figure 19:
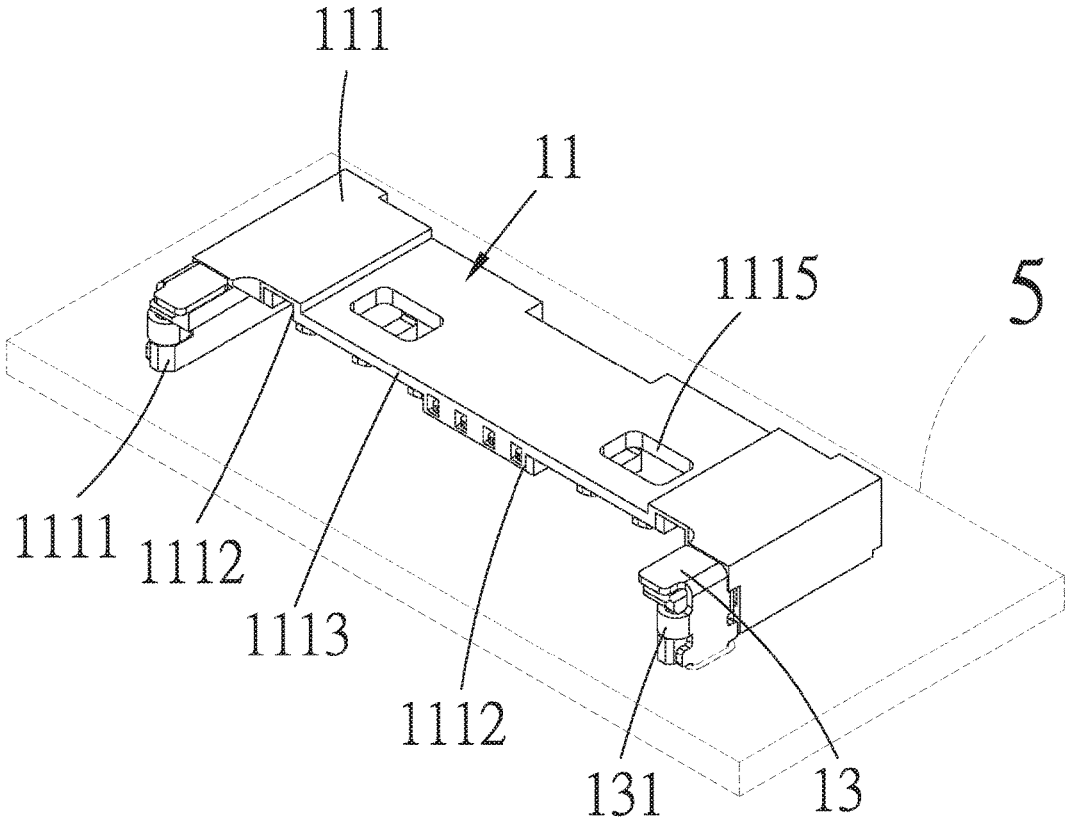
FIG. 19 is a schematic view showing usage of a board connector according to the invention.

As shown in FIGS. 19 and 20, the electrical connector assembly 1 may further include multiple reinforcement pieces 13, which are provided on two walls on inner and outer edges on two sides of the board insulator 111, and join with the circuit substrate 5 separately, to ensure lapping of the board signal terminal 1121 and the first, second board power terminals 1131, 1141 onto the circuit substrate 5. The wall on the inner edge of the board insulator 111 has an uneven profile for separate formations of a first, a second, a third level guiding structure 1111, 1112, 1113. In correspondence, as shown in FIGS. 5 and 6, the wall on the outer edge of the cable insulator 121 has an uneven profile for formations of a first, a second, a third insertion structures 1211, 1212, 1213.

Figure 27:
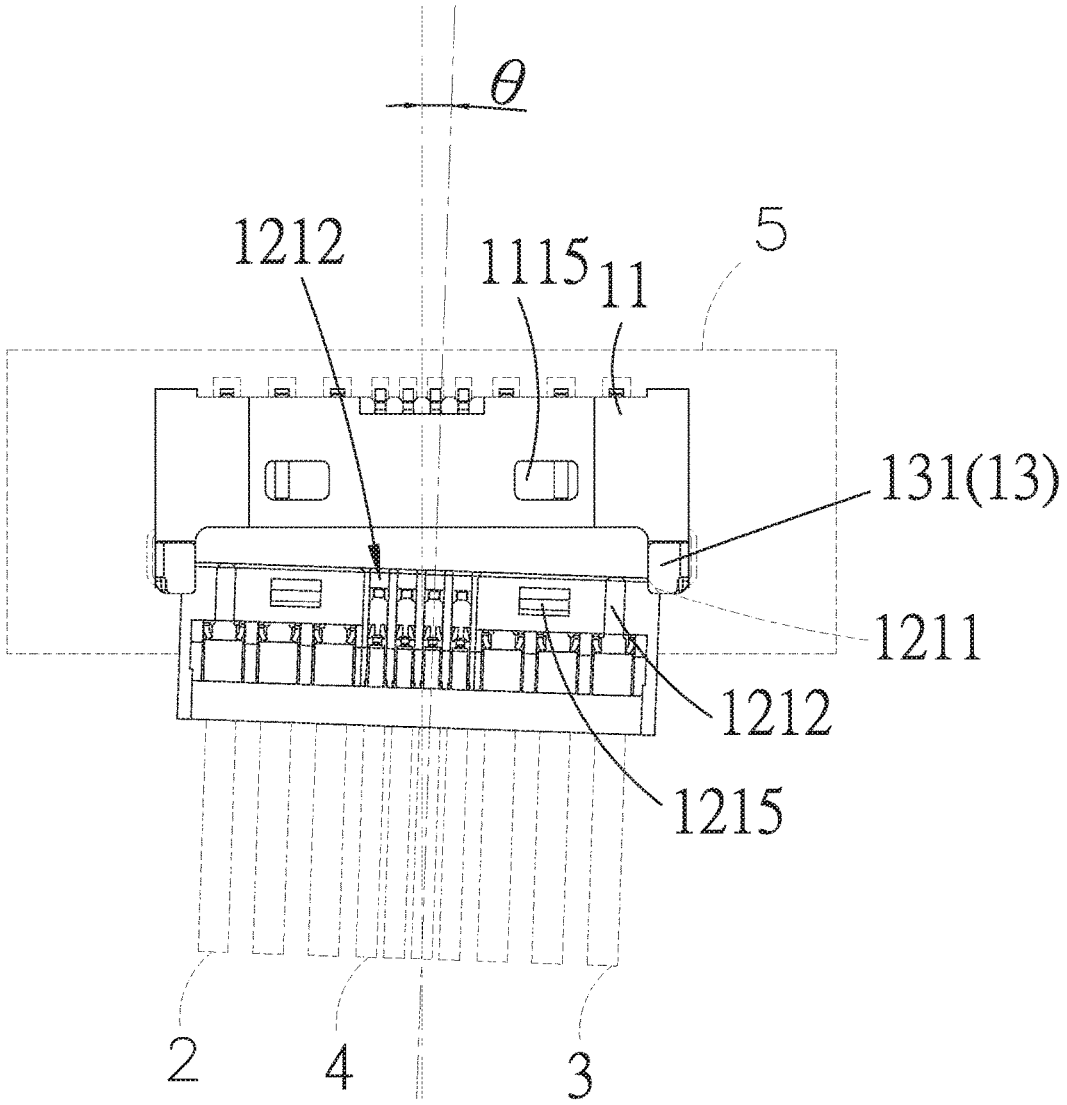
FIG. 27 is a schematic view showing docking of a cable connector with a board connector according to the invention.

Furthermore, in an example illustrated in FIG. 27, the opposing faces of the board insulator 111 and the cable insulator 121 are formed with a board clipping structure 1115 and a cable clipping structure 1215 separately, while the reinforcement piece 13 has an reinforcement piece guiding structure 131. When the cable connector 12 docks the board connector 11, the reinforcement piece guiding structure 131 guides the first level insertion structure 1211 to approach the first level guiding structure 111 within a predetermined angular range θ, such that the first, second, third level insertion structures 1211, 1212, 1213 are in separate correspondence with locations of the first, second, third level guiding structures 1111, 1112, 1113, for the first, second, third insertion structures 1211, 1212, 1213 to be guided and inserted in the board insulator 111 in sequence by stages until the board clipping structure 1115 clips the cable clipping structure 1215, for the cable signal terminal 1221 to contact the board signal terminal 1121, and for the first, second cable power terminals 1231, 1241 to clamp the first, second board power terminals 1131, 1141 separately and elastically. As such, the cable connector 12 docks the board connector 11.

Figure 9:
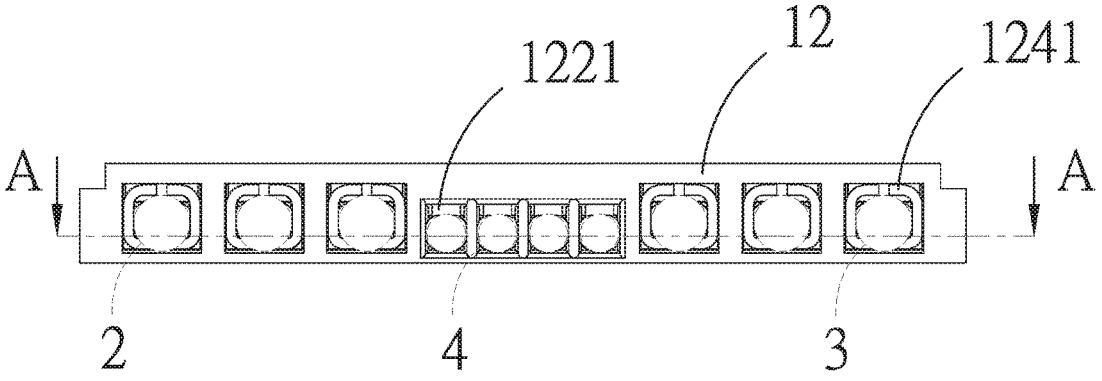
FIG. 9 is a rear view showing the cable connector shown in FIG. 5.
Figure 10:
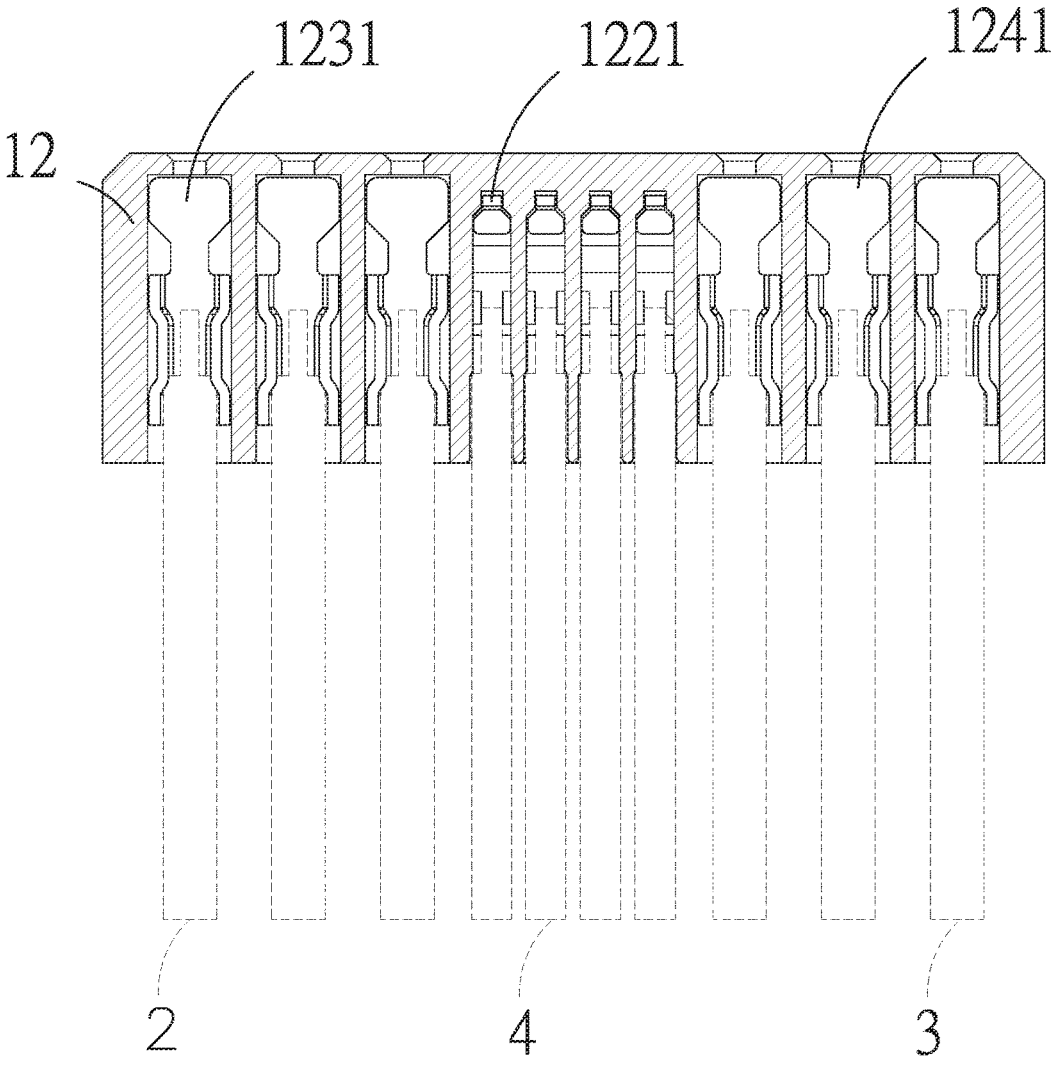
FIG. 10 is a sectional view of the cable connector taken along line AA in FIG. 9.
Figure 28:
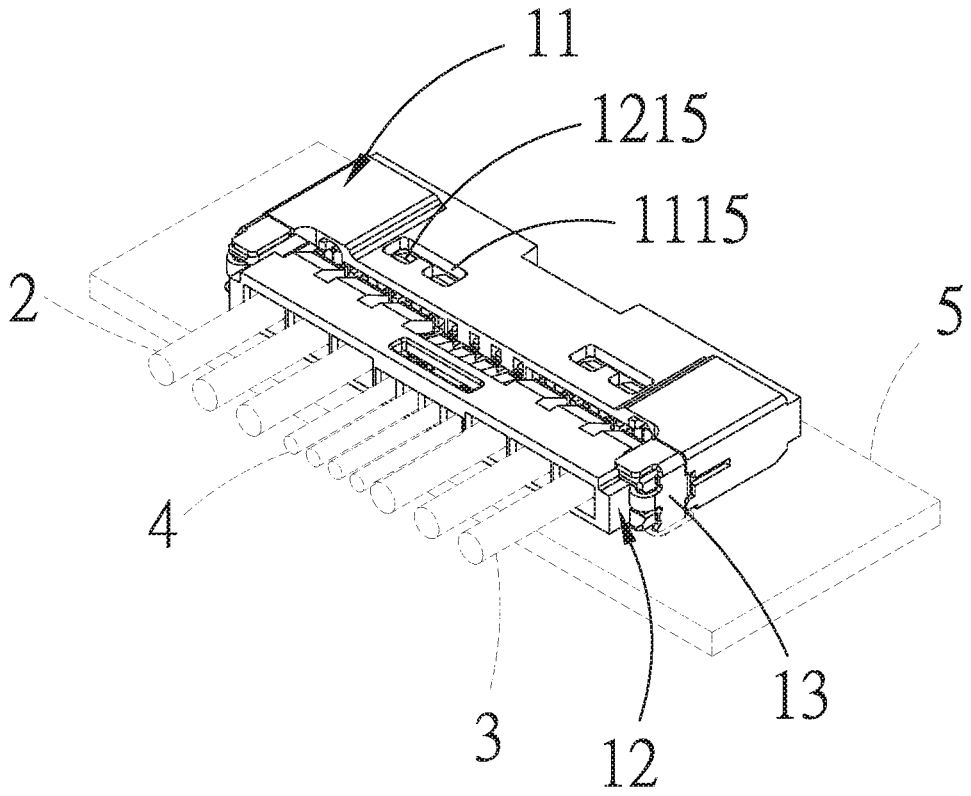
FIG. 28 is a schematic view showing usage of an electrical connector assembly according to the invention.
Figure 29:
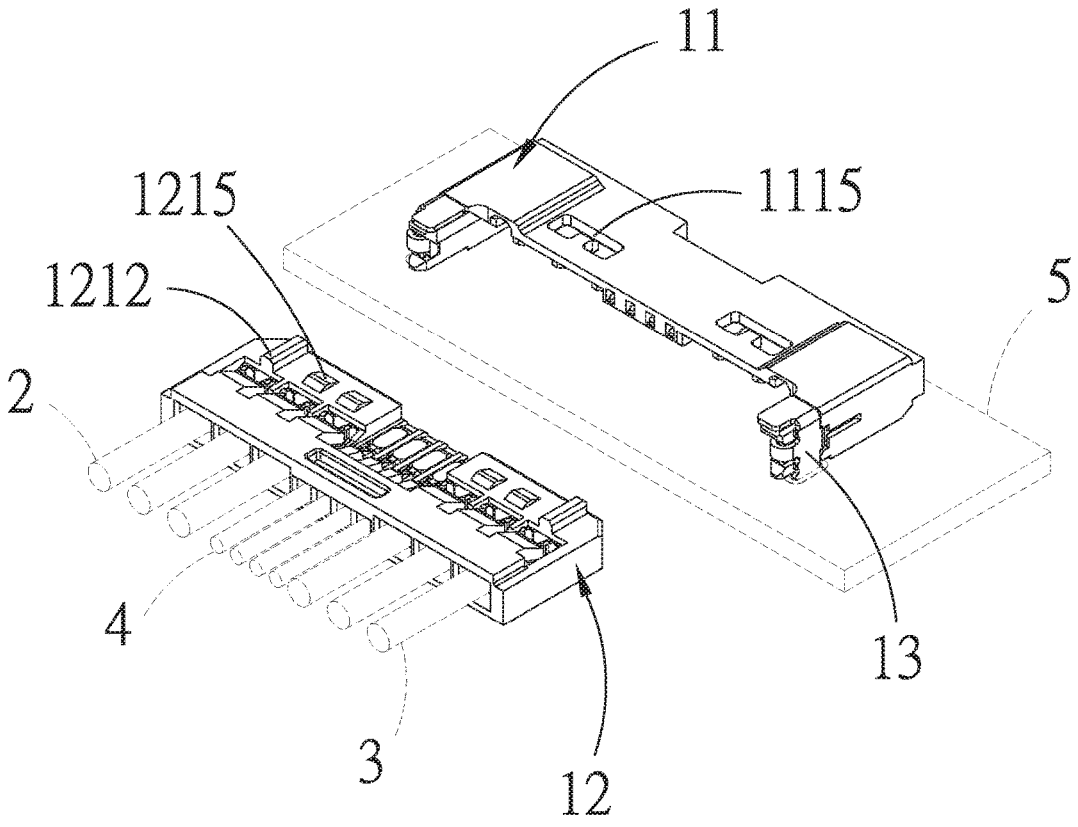
FIG. 29 is an exploded view of the electrical connector assembly shown in FIG. 28.

The board, cable clipping structures 1115, 1215 may be a hole and a bump separately which are structure fitted and may complete mutual clipping. As shown in FIG. 9, the board clipping structure 1115 is a rectangular hole. Additionally, as shown in FIGS. 28 and 29, the board clipping structure 1115 is a hole in shape of a Chinese character "凹", while the cable clipping structure 1215 is a bump in shape of a Chinese character "凸" in correspondence.

Figure 26:
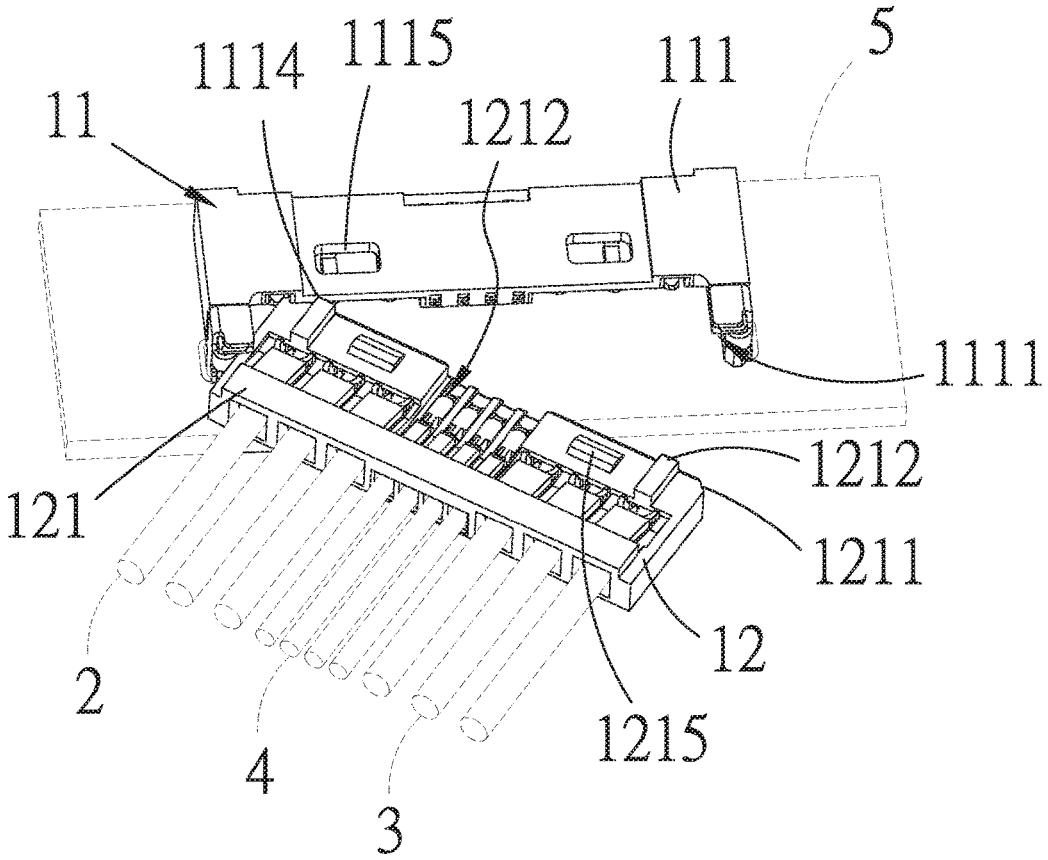
FIG. 26 is a schematic view showing a function of an insertion stop structure of a board insulator according to the invention.

Furthermore, as shown in FIG. 26, the board insulator 111 further has an insertion stop structure 1114, which stops the first level insertion structure 1211 of the cable insulator 121 from approaching the first level guiding structure 1111 at a non-predetermined angular range, so that the cable insulator 121 may be prevented from colliding the first, second board power terminals 1131, 1141 and the board signal terminal 1121 of the board connector 11 unexpectedly in an effective manner. Accordingly, service life of the board connector 11 is extended.

The examples above are only illustrative to explain principles and effects of the invention, but not to limit the invention. It will be apparent to those skilled in the art that modifications and variations can be made without departing from the spirit and scope of the invention. Therefore, the protection range of the rights of the invention should be as defined by the appended claims.

What is claimed is:

1. An electrical connector assembly for delivering a first power of a first power wire, a second power of a second power wire, and an electronic signal of a signal wire to a circuit substrate separately, the electrical connector assembly including:

a board connector having a board insulator, a board signal terminal set, a first board power terminal set and a second board power terminal set, wherein:

the first, second board power terminal sets and the board signal terminal set are embedded in the board insulator, and the board signal terminal set is located between the first, second board power terminal sets;

the board signal terminal set has at least one board signal terminal;

the first board power terminal set has at least one first board power terminal;

the second board power terminal set has at least one second board power terminal; and the first, second board power terminals and the board signal terminal have separate lapping parts exposed out of the board insulator for lapping the circuit substrate;

a cable connector for docking the board connector, the cable connector having a cable insulator, a cable signal terminal set, a first cable power terminal set and a second cable power terminal set, wherein:

the first, second cable power terminal sets and the cable signal terminal set are embedded in the cable insulator, and the cable signal terminal set is located between the first, second cable power terminal sets;

the cable signal terminal set has at least one cable signal terminal, one end of the cable signal terminal lapping the signal wire to receive the electronic signal, another end of the cable signal terminal having a cable resistive contact structure on a surface thereof, which is used to contact the board signal terminal resistively when the cable connector docks the board connector, for delivering the electronic signal to the circuit substrate via the board signal terminal;

the first cable power terminal set has at least one first cable power terminal, one end of the first cable power terminal lapping the first power wire to receive the first power, another end of the first cable power terminal having a first clamp arm structure, which is used to clamp the first board power terminal elastically when the cable connector docks the board connector, for delivering the first power to the circuit substrate via the first board power terminal;

the second cable power terminal set has at least one second cable power terminal, one end of the second cable power terminal lapping the second power wire to receive the second power, another end of the second cable power terminal having a second clamp arm structure, which is used to clamp the second board power terminal elastically when the cable connector docks the board connector, for delivering the second power to the circuit substrate via the second board power terminal;

wherein the board insulator has a first level guiding structure, a second level guiding structure and a third level guiding structure; the cable insulator has a first insertion structure, a second insertion structure and a third insertion structure; when the cable connector docks the board connector, the first, second, third level insertion structures are in separate correspondence with locations of the first, second, third level guiding structures, for the first, second, third insertion structures to be guided and inserted in the board insulator in sequence by stages until the cable signal terminal contacts the board signal terminal, and for the first, second cable power terminals to be guided clamping the first, second board power terminals separately and elastically; and multiple reinforcement pieces, which are provided on two walls on inner and outer edges on two sides of the board insulator, and join with the circuit substrate separately, to ensure lapping of the board signal terminal and the first, second board power terminals onto the circuit substrate; each of the multiple reinforcement pieces has an reinforcement piece guiding structure, for guiding the first level insertion structure to approach the first level guiding structure within a predetermined angular range.

2. The electrical connector assembly as claim 1, wherein a wall on an inner edge of the board insulator is formed of the first, second, third level guiding structures separately.

3. The electrical connector assembly as claim 1, wherein the board insulator further has an insertion stop structure, which stops the first level insertion structure of the cable insulator from approaching the first level guiding structure at a non-predetermined angular range.

4. The electrical connector assembly as claim 1, wherein the board signal terminal has both head and tail ends embedded in the board insulator; an elastic embossed structure is formed at a neck portion on a head end of the board signal terminal; the elastic embossed structure is exposed out of a middle portion of the inner edge of the board insulator, and protrudes toward the cable signal terminal for contacting the cable resistive contact structure.

5. The electrical connector assembly as claim 1, wherein head ends of the first, second board power terminals are formed of a first pillar structure and a second pillar structure separately for being clamped by the first, second cable power terminals elastically and separately; tail ends of the first, second board power terminals being embedded in the board insulator separately.

6. The electrical connector assembly as claim 1, wherein a head end of the cable signal terminal has a U-shaped structure; the cable insulator has a longitudinal stop structure, which is embedded in the U-shaped structure for stopping longitudinal motion of the head end of the cable signal terminal relative to the cable insulator.

7. The electrical connector assembly as claim 6, wherein the head end of the cable signal terminal has an embedding hole for passing through the longitudinal stop structure to complete the embedding of the longitudinal stop structure in the U-shaped structure.

8. The electrical connector assembly as claim 1, wherein opposing faces of the board, cable insulators are formed with a board clipping structure and a cable clipping structure separately in order to clip both of the board clipping structure and the cable clipping structure as the cable connector has docked the board connector.

* * * * *